US009650580B2

(12) United States Patent
Merdrignac et al.

(10) Patent No.: US 9,650,580 B2
(45) Date of Patent: May 16, 2017

(54) INTEGRATED PROCESS FOR THE TREATMENT OF OIL FEEDS FOR THE PRODUCTION OF FUEL OILS WITH A LOW SULPHUR AND SEDIMENT CONTENT

(71) Applicant: IFP Energies nouvelles, Rueil-Malmaison (FR)

(72) Inventors: Isabelle Merdrignac, Chaponnay (FR); Wilfried Weiss, Valencin (FR); Jerome Majcher, Lyons (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 15/105,314

(22) PCT Filed: Dec. 5, 2014

(86) PCT No.: PCT/EP2014/076775
§ 371 (c)(1),
(2) Date: Jun. 16, 2016

(87) PCT Pub. No.: WO2015/091033
PCT Pub. Date: Jun. 25, 2015

(65) Prior Publication Data

US 2016/0312130 A1 Oct. 27, 2016

(30) Foreign Application Priority Data

Dec. 17, 2013 (FR) ..... 13 62748

(51) Int. Cl.

| | |
|---|---|
| ***C10G 65/12*** | (2006.01) |
| ***C10G 67/04*** | (2006.01) |
| ***C10G 45/02*** | (2006.01) |
| ***C10G 45/08*** | (2006.01) |
| ***C10G 21/00*** | (2006.01) |
| ***C10G 21/06*** | (2006.01) |
| ***C10L 1/04*** | (2006.01) |
| ***C10L 1/08*** | (2006.01) |

(52) U.S. Cl.
CPC ..... *C10G 67/049* (2013.01); *C10G 21/003* (2013.01); *C10G 21/06* (2013.01); *C10G 45/02* (2013.01); *C10G 45/08* (2013.01); *C10L 1/04* (2013.01); *C10L 1/08* (2013.01); *C10G 65/12* (2013.01); *C10G 2300/1077* (2013.01); *C10G 2300/202* (2013.01); *C10G 2300/206* (2013.01); *C10G 2400/04* (2013.01); *C10G 2400/06* (2013.01); *C10G 2400/08* (2013.01); *C10L 2200/043* (2013.01); *C10L 2200/0446* (2013.01); *C10L 2270/026* (2013.01); *C10L 2270/04* (2013.01); *C10L 2290/10* (2013.01); *C10L 2290/543* (2013.01); *C10L 2290/544* (2013.01)

(58) Field of Classification Search
CPC ..... C10G 67/049; C10G 2300/1077; C10G 2300/206; C10G 2400/08; C10G 2400/04; C10L 1/08; C10L 1/04; C10L 2290/10; C10L 2200/0446; C10L 2270/026; C10L 2290/543; C10L 2270/04; C10L 2200/043
See application file for complete search history.

(56) References Cited

U.S. PATENT DOCUMENTS

| | | | | |
|---|---|---|---|---|
| 4,493,765 A * | 1/1985 | Long | C10G 21/003 208/309 |
| 5,147,846 A * | 9/1992 | Harrison | B41M 5/443 427/146 |
| 2004/0055934 A1 | 3/2004 | Tromeur et al. | |
| 2008/0011643 A1* | 1/2008 | Lenglet | C10G 67/00 208/58 |
| 2012/0061292 A1* | 3/2012 | Sanchez | C10G 21/003 208/95 |

FOREIGN PATENT DOCUMENTS

| | | |
|---|---|---|
| EP | 0128047 A1 | 12/1984 |
| EP | 1343857 A1 | 9/2003 |
| WO | 0248288 A1 | 6/2002 |

OTHER PUBLICATIONS

International Search Report dated Jan. 26, 2015, issued in corresponding PCT/EP2014/076775, 2 pages.

* cited by examiner

*Primary Examiner* — Randy Boyer
*Assistant Examiner* — Juan Valencia
(74) *Attorney, Agent, or Firm* — Millen, White, Zelano and Branigan, P.C.

(57) ABSTRACT

Treating a hydrocarbon feed having a sulphur content of at least 0.5% by weight, an asphaltenes content of at least 1% by weight, an initial boiling point of at least 340° C. and a final boiling point of at least 480° C., in order to obtain at least one deasphalted oil fraction with a sulphur content of 0.5% by weight or less and a sediment content of 0.1% by weight or less.

14 Claims, No Drawings

INTEGRATED PROCESS FOR THE TREATMENT OF OIL FEEDS FOR THE PRODUCTION OF FUEL OILS WITH A LOW SULPHUR AND SEDIMENT CONTENT

FIELD OF THE INVENTION

The present invention relates to the refining and conversion of heavy hydrocarbon fractions containing sulphur-containing impurities, inter alia. More particularly, it relates to a process for the treatment of heavy oil feeds for the production of fuel oils and fuel oil bases, in particular bunker fuels and bunker fuel bases, with a low sulphur content.

PRIOR ART

While regulations regarding the sulphur contents contained in fuels for land use, typically gasolines and diesels, have become extremely strict over the past decades, regulations regarding the sulphur content in marine fuels have until now only been slightly restrictive. In fact, fuels for marine use currently on the market may contain up to 3.5%, or even 4.5% by weight of sulphur. This means that vessels have become the principal source of sulphur dioxide emissions ($SO_2$).

In order to reduce these emissions, the International Maritime Organisation (IMO) has submitted recommendations as regards specifications concerning marine fuels (Annexe VI of the MARPOL convention). These recommendations are defined in the 2012 version of ISO standard 8217. The recommendations apply from now on to the emissions of $SO_x$ by maritime fuels. The equivalent sulphur content recommended for 2020 or 2025 is 0.5% by weight or less for vessels operating outside the Sulphur Emission Control Areas (SECA). Within the SECAs, the IMO envisages an equivalent sulphur content of 0.1% by weight or less for 2015.

Furthermore, another highly restrictive recommendation pertains to the sediment content after aging which, in accordance with the ISO standard 10307-2, must be 0.1% by weight or less.

Fuel oils used in maritime transport generally comprise atmospheric distillates, vacuum distillates, atmospheric residues and vacuum residues obtained from straight run processes or from a refining process, in particular hydrotreatment and conversion processes, these cuts possibly being used alone or as a mixture.

One aim of the present invention is to propose a process for the conversion of heavy oil feeds for the production of fuel oil bases, in particular in the form of a stable deasphalted oil, with a low sulphur content and a low sediment content after aging even at high conversions. In fact, during the conversion step, the high conversion of a heavy feed (comprising, for example, at least 75% of compounds with a boiling point of more than 540° C.) under severe conversion conditions is accompanied by sediment formation which is principally linked to the precipitation of asphaltenes and renders the unconverted heavy fraction unstable and unsuitable for use as bunker fuels or bunker fuel bases. Using the process in accordance with the invention with a selective deasphalting step means that a stable bunker fuel can be produced with a high conversion during the hydroconversion step.

Another aim of the present invention is to jointly produce, using the same process, atmospheric distillates (naphtha, kerosene, diesel), vacuum distillates and/or light gases (C1 to C4). Using the process in accordance with the invention, in particular a high conversion hydroconversion step, means that the yields of distillates can be substantially improved compared with a bunker fuel production process using only a fixed bed hydrotreatment step and an ebullated bed hydroconversion step. The naphtha and diesel type bases can be upgraded at the refinery for the production of automobile and aviation fuels such as, for example, superfuels, jet fuels and diesels.

Processes for the refining and conversion of heavy oil feeds comprising a first step for fixed bed hydrotreatment then an ebullated bed hydroconversion step have been described in patent documents CA 1 238 005, EP 1 343 857 and EP 0 665 282.

EP 0 665 282, which describes a heavy oil hydrotreatment process, is intended to prolong the service life of the reactors. CA 1 238 005 describes a process for the conversion of a heavy liquid hydrocarbon feed using a plurality of reactors in series, in which the conversion ratio is improved by means of a particular recycle of the heavy fraction obtained. The process disclosed in EP 1 343 857 is described as a hydrotreatment process which can employ a hydrodemetallization section which may be preceded by a guard zone of the type using permutable reactors, and a hydrodesulphurization section.

The Applicant's research has led to the development of a process which can be used to produce fuel oils and fuel oil bases from deasphalted oil obtained with a good yield and good stability, despite the use of a high conversion, by employing in succession a fixed bed hydrotreatment step, a hydroconversion step and a step for deasphalting the heavy fraction obtained from the hydroconversion step. It has been observed that by using the deasphalting step in accordance with the invention, in addition to eliminating the organic sediments formed by the precipitation of asphaltenes, catalyst fines can be eliminated, resulting in an improved stability of the deasphalted oil and a reduced sediment content after aging.

BRIEF DESCRIPTION OF THE INVENTION

The invention concerns a process for the treatment of a hydrocarbon feed having a sulphur content of at least 0.5% by weight, an asphaltenes content of at least 1% by weight, an initial boiling point of at least 340° C. and a final boiling point of at least 480° C., in order to obtain at least one deasphalted oil fraction with a sulphur content of 0.5% by weight or less and a sediment content of 0.1% by weight or less, comprising the following steps in succession:

a) a step for fixed bed hydrotreatment, in which the hydrocarbon feed and hydrogen are brought into contact over at least one hydrotreatment catalyst, b) optionally, a step for separating the effluent obtained from the hydrotreatment step a) into at least one light fraction and at least one heavy fraction, c) a step for hydroconversion of at least a portion of the effluent obtained from step a) or at least a portion of the heavy fraction obtained from step b) and optionally at least a portion of the light fraction obtained from step b) in at least one reactor containing at least one supported ebullated bed catalyst, d) a step for separating the effluent obtained from step c) in order to obtain at least one gaseous fraction and a liquid hydrocarbon fraction, e) at least one step for selective deasphalting in order to separate at least one asphalt fraction and at least one deasphalted oil fraction, the deasphalting step being carried out at least by bringing at least a portion of the liquid hydrocarbon fraction obtained from step d) into contact with a mixture of at least one polar solvent and at least one apolar solvent under subcritical conditions for the mixture of solvents used, f) a step for recycling at least a portion of said deasphalted oil fraction obtained from step e) upstream of the hydrotreatment step a) and/or to the inlet for the hydroconversion step c).

Advantageously, the deasphalting step e) comprises at least two deasphalting steps in series in order to separate at least one asphalt fraction, at least one deasphalted oil fraction termed heavy DAO and at least one light deasphalted oil fraction termed light DAO, at least one of said deasphalting steps being carried out by bringing at least a portion of the liquid hydrocarbon fraction obtained from step d) into contact with a mixture of at least one polar solvent and at least one apolar solvent under subcritical conditions for the mixture of solvents used.

Advantageously, at least a portion of the deasphalted oil fraction termed heavy DAO obtained from step e) is recycled upstream of the hydrotreatment step a) and/or to the inlet for the hydroconversion step c).

Advantageously, step e) is carried out at an extraction temperature in the range 50° C. to 350° C., and at a pressure in the range 0.1 to 6 MPa.

Advantageously, the fixed bed hydrotreatment step is carried out at a temperature in the range 300° C., to 500° C., at an absolute pressure in the range 2 MPa to 35 MPa, with an hourly space velocity of the hydrocarbon feed in the range from 0.1 $h^{-1}$ to 5 $h^{-1}$, and the quantity of hydrogen is in the range 100 $Nm^3/m^3$ to 5000 $Nm^3/m^3$.

Advantageously, the polar solvent used in step e) is selected from pure aromatic solvents or naphtheno-aromatic solvents, polar solvents comprising hetero-elements, or a mixture thereof or from cuts rich in aromatics such as cuts obtained from FCC (Fluid Catalytic Cracking), cuts derived from coal, from biomass or from a biomass/coal mixture.

Advantageously, the apolar solvent used in step e) comprises a solvent composed of a saturated hydrocarbon containing 2 or more carbon atoms, preferably in the range 2 to 9 carbon atoms.

Advantageously, the hydroconversion step c) is carried out at an absolute pressure in the range 2.5 MPa to 35 MPa, at a temperature in the range 330° C. to 550° C., with an hourly space velocity in the range from 0.1 $h^{-1}$ to 5 $h^{-1}$, and with a quantity of hydrogen of 50 $Nm^3/m^3$ to 5000 $Nm^3/m^3$.

The invention also concerns a deasphalted oil which is susceptible of being obtained in accordance with the process of the invention and which can be used as a fuel oil base.

DETAILED DESCRIPTION OF THE INVENTION

The hydrocarbon feed treated in the process in accordance with the invention may be classified as a heavy feed. It has an initial boiling point of at least 340° C. and a final boiling point of at least 480° C. Preferably, its initial boiling point is at least 350° C., preferably at least 375° C., and its final boiling point is at least 500° C., preferably at least 520° C. more preferably at least 550° C. and still more preferably at least 600° C.

The hydrocarbon feed may be selected from atmospheric residues, straight run vacuum residues, crude oils, topped crude oils, deasphalting resins, asphalts or deasphalted pitches, residues obtained from conversion processes, aromatic extracts obtained from production lines for lubricant bases, bituminous sands or their derivatives, oil shales or their derivatives, and source rock oils or their derivatives, used alone or as a mixture. In the present invention, the feeds which are treated are preferably atmospheric residues or vacuum residues, or mixtures of these residues.

The hydrocarbon feed treated in the process in accordance with the invention is sulphurized. Its sulphur content is at least 0.5% by weight, preferably at least 1% by weight, more preferably at least 2% by weight, still more preferably at least 3% by weight. The metals content of the feed is advantageously more than 110 ppm of metals (Ni+V), preferably more than 150 ppm.

Furthermore, the hydrocarbon feed treated in the process in accordance with the invention contains asphaltenes. Its asphaltenes content is at least 1% by weight. The term "asphaltene" as used in the present description means heavy hydrocarbon compounds which are insoluble in n-heptane (these are also known as C7 asphaltenes) but which are soluble in toluene. Asphaltenes are generally quantified with the aid of normalized analyses such as those defined, for example, in the AFNOR T 60-115 (France) or ASTM893-69 (United States of America) standards.

These feeds may advantageously be used as they are. Alternatively, the hydrocarbon feed may be diluted with a co-feed. This co-feed may be a hydrocarbon fraction or a mixture of lighter hydrocarbon fractions which may preferably be selected from products obtained from a fluidized bed catalytic cracking process (FCC, Fluid Catalytic Cracking), a light oil cut (LCO, Light Cycle Oil), a heavy oil cut (HCO, Heavy Cycle Oil), a decanted oil, a FCC residue, a diesel fraction, in particular a fraction obtained by atmospheric distillation or vacuum distillation such as vacuum diesel, for example, or indeed it may derive from another refining process. The co-feed may also advantageously be one or more cuts obtained from the coal liquefaction process or from biomass, from aromatic extracts, or from any other hydrocarbon cut, or indeed from non-oilfield feeds such as pyrolysis oil. The heavy hydrocarbon feed of the invention may represent at least 50%, preferably 70%, more preferably at least 80%, and still more preferably at least 90% by weight of the total hydrocarbon feed treated in the process of the invention.

Hydrotreatment Step a)

In the process of the present invention, said hydrocarbon feed undergoes a step a) for fixed bed hydrotreatment, in which the feed and hydrogen are brought into contact with a hydrotreatment catalyst.

In a variation, the hydrocarbon feed is sent to the hydrotreatment step a) as a mixture with at least a portion of the deasphalted oil obtained from step e).

In a variation, the hydrocarbon feed is sent to the hydrotreatment step a) as a mixture with at least a portion of the deasphalted oil fraction termed heavy DAO obtained from step e).

The term "hydrotreatment", routinely known as HDT, means catalytic treatments with the addition of hydrogen in order to refine hydrocarbon feeds, i.e. substantially reduce the quantity of metals, sulphur and other impurities, while improving the hydrogen-to-carbon ratio of the feed and partially transforming the feed into lighter cuts to a greater or lesser extent. Hydrotreatment in particular includes hydrodesulphurization reactions (routinely known as HDS), hydrodenitrogenation reactions (routinely known as HDN), and hydrodemetallization reactions (routinely known as HDM), accompanied by hydrogenation, hydrodeoxygenation, hydrodearomatization, hydroisomerization, hydrodealkylation, hydrocracking, hydrodeasphalting and Conradson Carbon reduction reactions.

In a preferred variation, the hydrotreatment step a) comprises a first step a1) for hydrodemetallization (HDM) carried out in one or more fixed bed hydrodemetallization zones, and a subsequent second step a2) for hydrodesulphurization (HDS), carried out in one or more fixed bed hydrodesulphurization zones. During said first hydrodemetallization step a1), the feed and hydrogen are brought into contact over a hydrodemetallization catalyst under hydrodemetallization conditions, then during said second step a2) for hydrodesulphurization, the effluent from the first step a1) for hydrodemetallization is brought into contact with a hydrodesulphurization catalyst under hydrodesulphurization conditions. This process, known by the name HYVAHL-F, is described, for example, in patent U.S. Pat. No. 5,417,846. The person skilled in the art will readily appreciate that hydrodemetallization reactions are carried out in the hydrodemetallization step, but at the same time, some other hydrotreatment reactions occur, in particular hydrodesulphurization. Similarly, hydrodesulphurization reactions occur in the hydrodesulphurization step, but at the same time, some other hydrotreatment reactions occur, in particular hydrodemetallization.

The hydrotreatment step a) of the invention is carried out under hydrotreatment conditions. It may advantageously be carried out at a temperature in the range 300° C. to 500° C., preferably in the range 350° C., to 420° C., and under an absolute pressure in the range 2 MPa to 35 MPa, preferably in the range 11 MPa to 20 MPa. The temperature is normally adjusted as a function of the desired degree of hydrotreatment and the envisaged treatment duration. Usually, the hourly space velocity of the hydrocarbon feed, normally known as the HSV, which is defined as the volumetric flow rate of feed divided by the total volume of catalyst, may be in the range from 0.1 $h^{-1}$ to 5 $h^{-1}$, preferably 0.1 $h^{-1}$ to 2 $h^{-1}$, more preferably in the range 0.1 $h^{-1}$ to 0.45 $h^{-1}$, and still more preferably 0.1 $h^{-1}$ to 0.2 $h^{-1}$. The quantity of hydrogen mixed with the feed may be in the range 100 to 5000 normal cubic meters ($Nm^3$) per cubic meter ($m^3$) of liquid feed, preferably in the range 200 $Nm^3/m^3$ to 2000 $Nm^3/m^3$, and more preferably in the range 300 $Nm^3/m^3$ to 1500 $Nm^3/m^3$. The hydrotreatment step a) may be carried out on an industrial scale in one or more liquid downflow reactors. The hydrotreatment step a), in particular the hydrodemetallization section (HDM), advantageously comprises permutable reactors which, inter alia, can be used to prolong the cycle duration of the process by periodically replacing the catalyst present in the permutable reactors. In a variation of the process, the hydrotreatment step a) comprises at least one moving bed reactor, generally located in the hydrodemetallization section (HDM).

The hydrotreatment catalysts used are preferably known catalysts. They may be granular catalysts comprising, on a support, at least one metal or compound of a metal having a hydrodehydrogenating function. These catalysts may advantageously be catalysts comprising at least one metal from group VIII, generally selected from the group constituted by nickel and cobalt, and/or at least one metal from group VIE, preferably molybdenum and/or tungsten. As an example, a catalyst comprising 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on a mineral support may be used. This support may, for example, be selected from the group constituted by alumina, silica, silica-aluminas, magnesia, clays and mixtures of at least two of these minerals. Advantageously, this support may include other doping compounds, in particular oxides selected from the group constituted by boron oxide, zirconia, cerine, titanium oxide, phosphoric anhydride and a mixture of these oxides. Usually, an alumina support is used, and more usually an alumina support doped with phosphorus and optionally with boron. When phosphoric anhydride, $P_2O_5$, is present, its concentration is less than 10% by weight. When boron trioxide $B_2O_3$ is present, its concentration is less than 10% by weight. The alumina used may be a y (gamma) alumina or eta ($r_i$) alumina. This catalyst is usually in the form of extrudates. The total quantity of oxides of metals from groups VIB and VIII may be 5% to 40% by weight, and in general 7% to 30% by weight, and the weight ratio, expressed as the metallic oxide, between the metal (or metals) from group VIB and the metal (or metals) from group VIII is generally in the range 20 to 1, and usually in the range 10 to 2.

In the case of a hydrotreatment step including a hydrodemetallization step (HDM) then a hydrodesulphurization (HDS) step, specific catalysts which are suitable for each step are preferably used.

Examples of catalysts which may be used in the hydrodemetallization step are indicated in patent documents EP 0 113 297, EP 0 113 284, U.S. Pat. Nos. 5,221,656, 5,827,421, 7,119,045, 5, 622,616 and 5,089,463. Preferably, hydrodemetallization catalysts are used in the permutable reactors.

Examples of catalysts which may be used in the hydrodesulphurization step are those indicated in patent documents EP 0 113 297, EP 0 113 284, U.S. Pat. Nos. 6,589,908, 4,818,743 or 6, 332,976.

It is also possible to use a mixed catalyst, which is active for hydrodemetallization and hydrodesulphurization, both in the hydrodemetallization section and in the hydrodesulphurization section, as described in patent document FR 2 940 143.

Prior to injection of the feed, the catalysts used in the process of the present invention preferably undergo an in situ or ex situ sulphurization treatment.

Separation step b)

The effluent obtained from the fixed bed hydrotreatment step a) advantageously undergoes at least one separation step, optionally completed by other supplemental separation steps, in order to separate at least one light fraction and at least one heavy fraction.

The term "light fraction" means a fraction in which at least 80% of the compounds have a boiling point of less than 350° C. The term "heavy fraction" means a fraction in which at least 80% of the compounds have a boiling point of 350° C. or more.

At least a portion of the heavy fraction is advantageously sent to the hydroconversion step c).

Preferably, the light fraction obtained during separation step b) comprises a gas phase and at least one light naphtha, kerosene and/or diesel type hydrocarbon fraction; at least a portion thereof is preferably used as a flux for a fuel oil.

The heavy fraction preferably comprises a vacuum distillate fraction and a vacuum residue fraction and/or an atmospheric residue fraction.

Separation step b) may be carried out using any method which is known to the person skilled in the art. This method may be selected from high or low pressure separation, high or low pressure distillation, high or low pressure stripping, liquid/liquid extraction and combinations of these various methods which may be operated at different pressures and temperatures.

In accordance with a first embodiment of the present invention, the effluent obtained from hydrotreatment step a) undergoes a separation step b) with decompression. In this embodiment, the separation is preferably carried out in a fractionation section which may initially comprise a high pressure high temperature (HPHT) separator and optionally a high pressure low temperature (HPLT) separator, optionally followed by low pressure separators and/or an atmospheric distillation section and/or a vacuum distillation section. The effluent from step a) may be sent to a fractionation section, generally to a high pressure high temperature (HPHT) separator, having a cut point between 200° C. and 400° C., in order to obtain a light fraction and a heavy fraction. In general, the separation is not carried out at a precise cut point, but rather it resembles a flash type separation. Preferably, said heavy fraction may then be decompressed in a low pressure high temperature (LPHT) separator in order to obtain a gas fraction and a liquid fraction.

The heavy fraction may then be sent directly to the hydroconversion step c).

The light fraction obtained from the high pressure high temperature (HPHT) separator may then be partially condensed in a high pressure low temperature (HPLT) separator in order to obtain a gas fraction and a liquid fraction. The liquid fraction obtained from the high pressure low temperature (HPLT) separator may then be decompressed in a low pressure low temperature (LPLT) separator in order to obtain a gas fraction and a liquid fraction.

The liquid fractions obtained from the low pressure high temperature (LPHT) and low pressure low temperature (LPLT) separators may be fractionated by atmospheric distillation into at least one atmospheric distillate fraction, preferably containing at least one light naphtha, kerosene and/or diesel type hydrocarbon fraction, and an atmospheric residue fraction. At least a portion of the atmospheric residue fraction may also be fractionated by vacuum distillation into a vacuum distillate fraction preferably containing vacuum diesel, and a vacuum residue fraction. At least a portion of the vacuum distillate fraction is preferably sent to the hydroconversion step c). Another portion of the vacuum distillate may be used as a flux for a fuel oil.

Preferably, at least one light naphtha, kerosene and/or diesel or vacuum diesel hydrocarbon fraction is used as the flux for a fuel oil.

Another portion of the vacuum distillate may be upgraded by undergoing a hydrocracking step and/or fluidized bed catalytic cracking. In the case in which a portion of the vacuum distillate undergoes catalytic cracking, conversion products of the LCO (Light Cycle Oil) and HCO (Heavy Cycle Oil) type may be used as the flux for a fuel oil.

Another portion of the atmospheric residue may also undergo a conversion process such as catalytic cracking.

A portion of the vacuum residue may also be recycled to the hydrotreatment step a).

In accordance with a second embodiment, a portion of the effluent obtained from hydrotreatment step a) undergoes a step b) for separation without decompression. In this embodiment, the effluent from the hydrotreatment step a) is sent to a separation section, generally to a high pressure high temperature (HPHT) separator, with a cut point in the range 200° C. to 400° C., in order to obtain at least one light fraction and at least one heavy fraction. In general, the separation is preferably not carried out using a precise cut point, but rather it resembles a flash type separation.

The heavy fraction may then be sent directly to the hydroconversion step c).

The light fraction obtained from the high pressure high temperature (HPHT) separator may undergo other separation steps. Advantageously, it may undergo an atmospheric distillation in order to obtain a gaseous fraction, at least one light liquid hydrocarbon fraction of the naphtha, kerosene and/or diesel type and a vacuum distillate fraction. Preferably, at least a portion of the light liquid naphtha, kerosene and/or diesel hydrocarbon fraction is used as a flux for a fuel oil. At least a portion of the vacuum distillate fraction is preferably sent to the hydroconversion step c).

Another portion of the vacuum distillate may upgraded by undergoing a step for hydrocracking and/or fluidized bed catalytic cracking. In the case in which a portion of the vacuum distillate undergoes a catalytic cracking, LCO (Light Cycle Oil) and HCO (Heavy Cycle Oil) type conversion products may be used as the flux for a fuel oil.

Still more advantageously, the light fraction obtained from the high pressure high temperature (HPHT) separator may be cooled then introduced into a high pressure low temperature (HPLT) separator in which a gas fraction containing hydrogen and a liquid fraction containing distillates are separated. This liquid fraction containing distillates may be sent to the hydroconversion step c) via a pump. Alternatively, this liquid fraction containing distillates may be sent to the final separation step d) which also treats the effluent obtained from the hydroconversion step c).

Separation without decompression means that the thermal integration is better, resulting in savings in energy and equipment. Furthermore, this embodiment has technico-economic advantages given that it is not necessary to increase the pressure of the streams after separation before the subsequent hydrocracking step. Intermediate fractionation without decompression is simpler than fractionation with decompression, and so the investment costs are also advantageously reduced.

The gas fractions obtained from the separation step preferably undergo a purification treatment in order to recover hydrogen and to recycle it to the hydrotreatment and/or hydroconversion reactors. The presence of the intermediate separation step between the hydrotreatment step a) and the hydroconversion step c) advantageously means that two independent hydrogen circuits are available, one connected to the hydrotreatment step, the other to the hydroconversion step, and which, depending on requirements, may be connected to one or the other. The hydrogen may be added to the hydrotreatment section or to the hydroconversion section or to both. The recycled hydrogen may supply the hydrotreatment section or the hydroconversion section, or both. One compressor may optionally be common to the two hydrogen circuits. The fact of being able to connect the two hydrogen circuits means that hydrogen management can be optimized and investments in terms of compressors and/or gaseous effluent purification units can be limited. The various implementations for hydrogen management which may be used in the present invention are described in patent application FR 2 957 607.

The light fraction obtained at the end of the separation step b) which comprises naphtha, kerosene and/or diesel type hydrocarbons or others, in particular LPG and vacuum diesel, may be upgraded using methods which are well known to the person skilled in the art.

At least a portion of the light fraction obtained from step b) is advantageously sent to the hydroconversion step c).

The heavy fraction, preferably comprising at least a portion of the vacuum distillate fraction, at least a portion of the vacuum residue fraction and/or the atmospheric residue fraction, is advantageously sent to the hydroconversion step c).

Hydroconversion Step c)

In accordance with the process of the present invention, at least a portion of the effluent obtained from step a) or at least a portion of the heavy fraction obtained from step b) when said step is carried out, and optionally at least a portion of the light fraction obtained from the separation step b) is sent to a hydroconversion step c) which is carried out in at least one reactor containing at least one ebullated bed supported catalyst. Preferably, the whole of the effluent obtained from step a) is sent to the hydroconversion step c). Said reactor may operate in upflow mode of liquid and gas. The principal aim of hydroconversion is to convert said heavy fraction into lighter fractions while at the same time partially refining them.

In a variation, the effluent obtained from step a) or at least a portion of the heavy fraction obtained from step b) when said step is carried out and optionally at least a portion of the light fraction obtained from the separation step b) is sent to the hydroconversion step c) as a mixture with at least a portion of the deasphalted oil fraction obtained from step e).

In a variation, the effluent obtained from step a) or at least a portion of the heavy fraction obtained from step b) when said step is carried out and optionally at least a portion of the light fraction obtained from separation step b) is sent to the hydroconversion step c) as a mixture with at least a portion of the deasphalted oil fraction termed heavy DAO obtained from step e).

The hydrogen necessary for the hydroconversion reaction may be injected into the inlet for the ebullated bed hydroconversion section c). It may be recycled hydrogen and/or makeup hydrogen. In the case in which several ebullated bed reactors are available in the hydroconversion section, hydrogen may be injected into the inlet to each reactor.

Ebullated bed technology is well known to the person skilled in the art. Only the principal operating conditions will be described here.

The catalysts remain inside the reactors and are not evacuated with the products except during the phases for makeup and withdrawal of catalysts which are necessary in order to maintain the catalytic activity. The temperature levels may be high in order to obtain high conversions while minimizing the quantities of catalysts employed.

The conditions for the ebullated bed hydroconversion step c) may be conventional conditions for ebullated bed hydroconversion of a heavy hydrocarbon feed. It may be operated at an absolute pressure in the range 2.5 MPa to 35 MPa, preferably in the range 5 MPa to 25 MPa, more preferably in the range 6 MPa to 20 MPa, and still more preferably in the range 11 MPa to 20 MPa, even more preferably in the range 13 MPa to 18 MPa, at a temperature in the range 330° C. to 550° C., preferably in the range 350° C. to 500° C., more preferably in the range 390° C. to 490° C. The hourly space velocity (HSV) and the partial pressure of hydrogen are parameters which are fixed as a function of the characteristics of the product to be treated and the desired conversion. The HSV (defined as the volumetric flow rate of the feed divided by the total volume of the reactor) is generally in the range 0.1 $h^{-1}$ to 5 $h^{-1}$, preferably in the range 0.15 $h^{-1}$ to 2 $h^{-1}$ and more preferably in the range 0.15 $h^{-1}$ to 1 $h^{-1}$. The quantity of hydrogen mixed with the feed is usually 50 to 5000 normal cubic meters ($Nm^3$) per cubic meter ($m^3$) of liquid feed, usually 100 $Nm^3/m^3$ to 1500 $Nm^3/m^3$ and preferably 200 $Nm^3/m^3$ to 1200 $Nm^3/m^3$.

It is possible to use a conventional granular hydroconversion catalyst with a dimension of the order of 1 mm. The catalyst is usually in the form of extrudates or beads. Typically, the catalyst comprises a support with a pore distribution which is adapted to the treatment of the feed, preferably amorphous and highly preferably alumina; a silica-alumina support may also be envisaged in certain cases; and at least one metal from group VIII selected from nickel and cobalt, and preferably nickel, said element from group VIII preferably being used in association with at least one metal from group VIB selected from molybdenum and tungsten; preferably, the metal from group VIB is molybdenum.

Preferably, the hydroconversion catalyst comprises nickel as the element from group VIII and molybdenum as the element from group VIB. The nickel content is advantageously in the range 0.5% to 15%, expressed as the weight of nickel oxide (NiO), preferably in the range 1% to 10% by weight, and the molybdenum content is advantageously in the range 1% to 40%, expressed as the weight of molybdenum trioxide ($MoO_3$), preferably in the range 4% to 20% by weight. Said catalyst may also advantageously contain phosphorus, the phosphorus oxide content preferably being less than 20% by weight, preferably less than 10% by weight.

In accordance with the invention, the spent hydroconversion catalyst may be partially replaced with fresh catalyst, by withdrawal preferably from the bottom of the reactor, and by introducing fresh or regenerated or rejuvenated catalyst either into the top or into the bottom of the reactor, preferably at regular intervals, and more preferably in batches or quasi-continuously. The rate of replacement of spent hydroconversion catalyst with fresh catalyst is advantageously in the range 0.01 kilograms to 10 kilograms per cubic meter of treated feed, and preferably in the range 0.3 kilograms to 3 kilograms per cubic meter of treated feed. This withdrawal and replacement are carried out with the aid of devices advantageously allowing for continuous operation of this hydroconversion step.

It is also possible to send the spent catalyst withdrawn from the reactor to a regeneration zone in which the carbon and sulphur it contains are eliminated, then to return this regenerated catalyst to the hydroconversion step a). It is also advantageously possible to send the spent catalyst withdrawn from the reactor to a rejuvenation zone in which the major portion of the deposited metals is eliminated before sending the spent catalyst and rejuvenated catalyst to a regeneration zone in which the carbon and sulphur it contains are eliminated, then to return this regenerated catalyst to the hydroconversion step a).

This hydroconversion step c) of the process of the invention may be carried out under the conditions of the H-OIL® process as described, for example, in the patent U.S. Pat. No. 6,270,654.

The hydroconversion catalyst used in the hydroconversion step c) may advantageously be used to ensure both demetallization and desulphurization, under conditions which may be used to obtain a liquid feed with a reduced metals content, Conradson Carbon content and sulphur content and to obtain a high conversion into light products, i.e. in particular, gasoline and diesel fuel fractions.

Step c) is advantageously carried out in one or more three-phase hydroconversion reactors, preferably one or more three-phase hydroconversion reactors with intermediate settler drums. Each reactor advantageously comprises a recirculating pump in order to keep the catalyst as an ebullated bed by continuously recycling at least a portion of a liquid fraction advantageously withdrawn from the head of the reactor and reinjected into the bottom of the reactor.

Separation Step d)

The effluent obtained from step c) undergoes at least one separation step d), optionally supplemented by other supplemental separation steps, in order to separate at least one gaseous fraction and a liquid hydrocarbon fraction.

The effluent obtained at the end of hydroconversion step c) comprises a liquid hydrocarbon fraction and a gaseous fraction containing gases, in particular $H_2$, $H_2S$, $NH_3$ and C1-C4 hydrocarbons. This gaseous fraction may be separated from the effluent with the aid of separation devices which are well known to the person skilled in the art, in particular with the aid of one or more separator drums which may be operated at different pressures and temperatures, optionally associated with a steam or hydrogen stripping means.

The effluent obtained at the end of the hydroconversion step c) is advantageously separated in at least one separator drum into at least one gaseous fraction and at least one liquid hydrocarbon fraction. These separators may, for example, be high pressure high temperature (HPHT) separators and/or high pressure low temperature (HPLT) separators.

After optional cooling, this gaseous fraction is preferably treated in a hydrogen purification means in order to recover hydrogen which has not been consumed during the hydrotreatment and hydroconversion reactions. The hydrogen purification means may be an amine scrubber, a membrane, a PSA (Pressure Swing Adsorption) type system, or a plurality of these means in series.

The purified hydrogen may then advantageously be recycled to the process of the invention, after optional recompression. The hydrogen may be introduced into the inlet to the hydrotreatment step a) and/or to the inlet for the hydroconversion step c).

Separation step d) may also comprise an atmospheric distillation and/or vacuum distillation step.

Advantageously, separation step d) initially comprises an atmospheric distillation, in which the effluent obtained at the end of step c) is fractionated by atmospheric distillation into at least one atmospheric distillate fraction and at least one atmospheric residue fraction, then a vacuum distillation in which at least a portion of the atmospheric residue fraction obtained after atmospheric distillation is fractionated by vacuum distillation into at least one vacuum distillate fraction and at least one vacuum residue fraction; and the liquid hydrocarbon fraction sent to the step e) comprises at least a portion of said vacuum residue fraction and optionally a portion of said vacuum distillate fraction.

The vacuum distillate fraction typically contains fractions of the vacuum diesel type. At least a portion of the vacuum distillate fraction may undergo a hydrocracking step or a catalytic cracking step.

At least a portion of the atmospheric residue fraction is advantageously sent to the hydroconversion step c).

At least a portion of the vacuum residue fraction may also be recycled to the hydrotreatment step a).

At least a portion of the atmospheric distillate fraction may also be recycled to the hydrotreatment step a) in order to reduce the viscosity of the flux at the inlet to the hydrotreatment step in the case of a treatment of a very viscous feed of the vacuum residue type.

Deasphalting Step e)

The effluent obtained from the hydroconversion step c), and in particular the heaviest liquid hydrocarbon fraction obtained after the separation step d), may contain sediments and catalyst residues obtained from fixed bed step a) and/or ebullated bed step c) in the form of fines.

The liquid hydrocarbon fraction obtained after step d) advantageously comprises at least a portion of the vacuum residue fraction and optionally a portion of the vacuum distillate fraction obtained from the separation step d) obtained after carrying out an atmospheric distillation and/or a vacuum distillation.

The process of the invention comprises a selective deasphalting step e) carried out under specific conditions for obtaining a stable deasphalted oil with an improved yield compared with a conventional deasphalting. Said deasphalting step may be carried out in one step or at least two steps. Step e) may also be used to separate sediments and fines contained in the liquid hydrocarbon fraction obtained from separation step d).

In the remainder of the text and in the foregoing, the expression "mixture of solvents in accordance with the invention" is intended to mean a mixture of at least one polar solvent and at least one apolar solvent in accordance with the invention.

In the remainder of the text and in the foregoing, the expression "deasphalted oil" is intended to mean a deasphalted oil termed DAO obtained when step e) is carried out in one step, but also to mean the deasphalted oil termed heavy DAO obtained when step e) is carried out in at least two steps.

The deasphalting step e) may be carried out in one step by bringing the liquid hydrocarbon fraction obtained from separation step d) into contact with a mixture of at least one polar solvent and at least one apolar solvent, in a manner such as to obtain an asphalt fraction and a deasphalted oil fraction termed DAO, step e) being carried out under subcritical conditions for the mixture of solvents used.

In a variation, the deasphalting step e) may comprise at least two deasphalting steps in series carried out on the liquid hydrocarbon fraction obtained from step d), in order to separate at least one asphalt fraction, at least one deasphalted oil fraction termed heavy DAO and at least one light deasphalted oil fraction termed light DAO, at least one of said deasphalting steps being carried out using a mixture of solvents, said deasphalting steps being carried out under subcritical conditions for the mixture of solvents used.

The deasphalting step e) can be used to go further in keeping all or a portion of the polar structures of the heavy resins and the asphaltenes which are the principal constituents of the asphalt phase in solution in the oil matrix. The deasphalting step e) can thus be used to select which type of polar structures remain dissolved in the deasphalted oil matrix. As a consequence, it can be used to selectively extract, from the liquid hydrocarbon fraction obtained from step d), only a portion of this asphalt, i.e. the most polar structures and the most refractory structures.

The extracted asphalt corresponds to the ultimate asphalt essentially composed of refractory polyaromatic and/or heteroatomic molecular structures.

The deasphalting step e) carried out in two steps may be used to separate the feed into three fractions: an asphalt fraction termed the ultimate fraction, which is enriched in impurities and in compounds which are refractory to upgrading, a deasphalted oil fraction termed heavy DAO, enriched in the least polar non-refractory resin and asphaltene structures but which generally remain contained in the asphalt fraction in the case of conventional deasphalting in one or more steps, and a light deasphalted oil fraction termed light DAO, which is depleted in resins and asphaltenes, and generally in impurities (metals, heteroatoms).

Step e) may be carried out in an extraction column or extractor, preferably in a mixer-settler. Preferably, the mixture of solvents in accordance with the invention is introduced into the extraction column or a mixer-settler at different points. Preferably, the mixture of solvents in accordance with the invention is introduced into an extraction column or a mixer-settler at a single point of introduction.

Step e) is carried out under subcritical conditions for said mixture of solvents, i.e. at a temperature which is below the critical temperature of the mixture of solvents. Step e) is carried out at an extraction temperature which is advantageously in the range 50° C. to 350° C., preferably in the range 90° C. to 320° C., more preferably in the range 100° C. to 310° C., more preferably between 120° C. and 310° C., yet more preferably in the range 150° C. to 310° C., and at a pressure which is advantageously in the range 0.1 to 6 MPa, preferably in the range 2 to 6 MPa.

The volume ratio of the mixture of solvents of the invention (volume of polar solvent +volume of apolar solvent) to the mass of liquid hydrocarbon fraction obtained from step d) is generally in the range 1/1 to 10/1, preferably in the range 2/1 to 8/1, expressed in litres per kilogram.

The polar solvent used may be selected from pure or naphtheno-aromatic solvents, polar solvents comprising hetero-elements, or a mixture thereof. The aromatic solvent is advantageously selected from monoaromatic hydrocarbons, preferably benzene, toluene or xylenes, alone or as a mixture; diaromatics or polyaromatics; aromatic naphtheno-hydrocarbon hydrocarbons such as tetraline or indane; heteroatomic aromatic hydrocarbons (oxygen-containing, nitrogen-containing, sulphur-containing) or any other family of compounds having a more polar nature than the saturated hydrocarbons such as, for example, dimethylsulphoxide (DMSO), dimethylformamide (DMF), or tetrahydrofuran (THF). The polar solvent used in the process of the invention may be an aromatics-rich cut. The aromatics-rich cuts of the invention may, for example, be cuts obtained from FCC (Fluid Catalytic Cracking), such as heavy gasoline, or LCO (Light Cycle Oil) or obtained from petrochemistry units at the refinery. Cuts derived from coal, from biomass or from a biomass/coal mixture, possibly with a residual oil feed after thermochemical conversion with or without hydrogen, with or without catalyst, may also be mentioned. Preferably, the polar solvent used is a monoaromatic hydrocarbon which is pure or mixed with an aromatic hydrocarbon.

The apolar solvent used is preferably a solvent composed of saturated hydrocarbon(s) containing 2 or more carbon atoms, preferably in the range 2 to 9. These solvents are used pure or as a mixture (as an example: a mixture of alkanes and/or cycloalkanes or indeed light naphtha type oil cuts).

Advantageously, the proportion of polar solvent in the mixture of polar solvent and apolar solvent is in the range 0.1% to 99.9%, preferably in the range 0.1% to 95%, more preferably in the range 1% to 95%, more preferably in the range 1% to 90%, still more preferably in the range 1% to 85%, and highly preferably in the range 1% to 80%.

Advantageously, the boiling point of the polar solvent of the mixture of solvents of the invention is higher than the boiling point of the apolar solvent.

The choice of the temperature and pressure conditions for the extraction combined with the choice of the nature of the solvents and the choice of the combination of apolar and polar solvents in the deasphalting step means that the extraction performances can be adjusted. The deasphalting conditions can be used to overcome the limitations in yield of deasphalted oil which are imposed in conventional deasphalting using paraffinic solvents. Because of the specific deasphalting conditions, step e) can be used to go further in maintaining all or a portion of the polar structures of the heavy resins and asphaltenes, which are the principal constituents of the asphalt phase in the case of conventional deasphalting, in solution in the oil matrix. Thus, step e) can be used to selectively extract an asphalt fraction termed ultimate, enriched in impurities and fines, while leaving at least a portion of the polar structures of the heavy resins and the least polar asphaltenes dissolved in the oil matrix. This results in an improved, stable deasphalted oil with a sediment content after aging of 0.1% or less.

When the deasphalting step e) comprises at least two deasphalting steps in series, this may be carried out in accordance with two different embodiments.

In a first embodiment, step e) is carried out in a configuration which is known as decreasing polarity, i.e. the polarity of the mixture of solvents used during the first deasphalting step is higher than that of the mixture of solvents used during the second deasphalting step. This configuration can be used to extract an asphalt fraction termed the ultimate fraction and a complete deasphalted oil fraction termed complete DAO during the first deasphalting step; the two fractions, termed the heavy deasphalted oil, heavy DAO, and the light deasphalted oil, termed light DAO, being extracted from the complete deasphalted oil during the second deasphalting step; said deasphalting steps being carried out under subcritical conditions for the mixture of solvents used.

In a second embodiment, step e) is carried out in a configuration which is known as increasing polarity, i.e. the polarity of the mixture of solvents used during the first deasphalting step is lower than that of the mixture of solvents used during the second deasphalting step. In a configuration of this type, during the first step a light deasphalted oil fraction known as light DAO and an effluent comprising an oil phase and an asphalt phase are extracted; said effluent then undergoes a second deasphalting step in order to extract an asphalt fraction and a deasphalted oil fraction termed heavy DAO; said deasphalting steps are carried out under subcritical conditions for the mixture of solvents used.

The deasphalted oil obtained from step e) (deasphalted oil termed DAO or deasphalted oil termed heavy DAO) with at least a portion of the mixture of solvents of the invention preferably undergoes at least one separation step in which said deasphalted oil is separated from the mixture of solvents of the invention.

This deasphalted oil may be used at least in part as a fuel oil base or as a fuel oil, in particular as a bunker fuel base or as a bunker fuel, with a low sulphur content complying with the new recommendations from the International Maritime Organisation and complying with the specifications described in the ISO standard 10307-2, namely an equivalent sulphur content of 0.5% by weight or less and a sediment content after aging of 0.1% by weight or less.

The term "fuel oil" as used in the invention means a hydrocarbon feed which can be used as a fuel. The term "fuel oil base" as used in the invention means a hydrocarbon feed which, when mixed with other bases, constitutes a fuel oil.

Fluxing and Fuel Oils

One aim of the present invention is to produce commercialisable fuel oils, in particular bunker fuel for maritime transport. It is preferable for this type of fuel oil to comply with certain specifications, in particular in terms of viscosity. Preferably, a very common type of bunker fuel has a viscosity of 380 cSt or less (at 50° C.). Other qualities of fuel oils, known as "grades", comply with different specifications, in particular as regards the viscosity. Particularly for fuels of the distillate type, the grade DMA imposes a viscosity in the range 2 cSt to 6 cSt at 40° C. and the grade DMB imposes a viscosity in the range 2 cSt to 11 cSt at 40° C. In order to obtain, inter alia, the target viscosity of the desired grade of fuel oil, the deasphalted oil fraction (deasphalted oil termed DAO or deasphalted oil termed heavy DAO) is used as a fuel oil base and may be mixed, if necessary, with one or more fluxing bases or "cutter stocks". Examples of specifications for fuel oils are described in ISO standard 8217 (latest version in 2012).

Cutter stocks are generally of the kerosene, diesel or vacuum diesel type. They may be selected from the group constituted by light oil cuts (LCO: Light Cycle Oil) from catalytic cracking, heavy oil cuts (HCO: Heavy Cycle Oil) from catalytic cracking, residue from catalytic cracking, kerosene, diesel, vacuum distillate and/or decanted oil.

Most particularly preferably, said cutter stock is selected from a portion of the light kerosene and/or diesel or vacuum diesel type hydrocarbon fraction obtained from the separation step b).

One particular embodiment could be constituted by incorporating a portion of the atmospheric residue and/or vacuum residue obtained from hydrotreatment step a) into the mixture comprising at least one deasphalted oil fraction (deasphalted oil termed DAO or deasphalted oil termed heavy DAO).

At the end of this step for mixing the deasphalted oil obtained from step e) with one or more cutter stocks, a fuel oil is obtained which can be used in maritime transport, also known as bunker fuel, with a low sulphur content and sediment content in accordance with the invention.

EXAMPLES

Example 1 (Not in Accordance with the Invention)

A vacuum residue feed (RSV Oural) with an initial temperature of 362° C. and a final temperature of more than 615° C. (49% distilled at 615° C.), i.e. 82.5% by weight of compounds boiling at a temperature of more than 540° C. was treated. The density of the feed was 9.2° API, the sulphur content was 2.7% by weight, the Ni+V metals content was 253 ppm and the C7 asphaltenes content was 3.9% by weight.

The feed underwent a hydrotreatment step including two permutable reactors. The operating conditions for the fixed bed hydrotreatment step are given in Table 1. The following were used:

- a NiMo on alumina catalyst, active for hydrodemetallization (HDM), sold by Axens with reference HF858,
- and a NiMo on alumina catalyst, active for hydrodesulphurization (HDS), sold by Axens with reference HT438.

TABLE 1

Operating conditions for hydrotreatment step with fixed bed(s)

| | |
|---|---|
| HDM catalyst (reference Axens) | NiMo on alumina (HF858) |
| HDS catalyst (reference Axens) | NiMo on alumina (HT438) |
| Temperature (° C.) | 370 |
| Pressure (MPa) | 15 |
| HSV ($h^{-1}$, $Sm^3$/h fresh feed/$m^3$ of fixed bed catalyst) | 0.19 |
| $H_2$/feed at inlet to hydrotreatment section without $H_2$ consumption ($Nm^3/m^3$ of fresh feed) | 1000 |

The hydrotreatment effluent underwent a separation step in order to obtain a light fraction and a heavy fraction. The light fraction underwent other separation steps in order to recover a gas rich in hydrogen and distillates. The heavy fraction was sent, as a mixture with a hydrogen-rich gas, to a hydroconversion step comprising an ebullated bed reactor. The operating conditions for the ebullated bed hydroconversion step are given in Table 2. A NiMo on alumina catalyst sold by Axens with reference HOC458 was used.

TABLE 2

Operating conditions for ebullated bed hydroconversion step

| | |
|---|---|
| Catalyst (reference Axens) | NiMo on alumina (HOC458) |
| Temperature (° C.) | 420 |
| Pressure (MPa) | 15 |
| HSV ($h^{-1}$, $Sm^3$/h fresh feed/$m^3$ of ebullated bed reactors) | 0.4 |
| $H_2$/heavy fraction at inlet to ebullated bed hydroconversion section without $H_2$ consumption ($Nm^3/m^3$ of fresh feed) | 500 |

The effluent from the ebullated bed hydroconversion step underwent a separation step in order to recover at least one hydrogen-rich gas, atmospheric distillates, a vacuum distillate and a vacuum residue. The yield with respect to the fresh feed and the sulphur content of each fraction obtained in the overall concatenation of fixed bed hydrotreatment+ebullated bed hydroconversion are given in Table 3.

TABLE 3

Yields (Yld) and sulphur content (S) at outlet from overall fixed bed + ebullated bed concatenation (% by weight/fresh feed)

| Products | Yld (% by wt) | S (% by wt) |
|---|---|---|
| $NH_3$ | 0.18 | 0 |
| $H_2S$ | 2.38 | 94.12 |
| $C_1$-$C_4$ (gas) | 2.36 | 0 |
| Naphtha (PI - 180° C.) | 4.73 | 0.005 |
| Diesel (180° C.-350° C.) | 15.16 | 0.03 |
| Vacuum distillate (350° C.-540° C.) | 37.13 | 0.25 |
| Vacuum residue (540° C.+) | 39.6 | 0.56 |

The hydrogen consumed over the whole process represented 1.54% by weight of the fresh feed introduced to the inlet of the hydrotreatment section. The overall conversion into vacuum residue fraction (540° C.+) was 52%.

A mixture A was prepared from the vacuum distillate (350° C.–540° C.) and vacuum residue (540° C.+) fractions obtained from the hydroconversion step in the following proportions:

- vacuum distillate fraction (350° C.–540° C.): 46% by weight of mixture A,
- vacuum residue fraction (540° C.+): 54% by weight of mixture A.

A bunker fuel A was obtained with a sulphur content of 0.42% by weight and with a viscosity of 380 cSt at 50° C. However, its sediment content after aging was 0.6% by weight, i.e. 0.5% by weight over specification ISO 8217.

Example 2 (In Accordance with the Invention)

A vacuum residue feed (RSV Oural) with an initial temperature of 362° C. and a final temperature of more than 615° C. (49% distilled at 615° C.) was treated, i.e. 82.5% by weight of compounds boiling at a temperature of more than 540° C. The density of this feed was 9.2° API, the sulphur content was 2.7% by weight, the Ni+V metals content was 253 ppm and the C7 asphaltenes content was 3.9% by weight.

The feed initially underwent the same steps as those described above, under the same operating conditions: a fixed bed hydrotreatment step including two permutable reactors, a separation step in order to recover at least one heavy fraction, a hydroconversion step for the heavy fraction mixed with a portion of the deasphalted oil DAO (recycled DAO) comprising an ebullated bed reactor and a separation step in order to recover at least one hydrogen-rich gas, atmospheric distillates, a vacuum distillate and a vacuum residue.

Next, the whole of said vacuum residue was sent to a selective deasphalting unit under the operating conditions given in Table 4. A mixture of apolar solvent (heptane) and polar solvent (toluene) was used.

TABLE 4

| Operating conditions for selective deasphalting | |
|---|---|
| Ratio of polar/apolar solvents (v/v) | 97/3 |
| Ratio of solvent/feed (v/m) | 5/1 |
| Pressure (MPa) | 4 |
| Temperature (° C.) | 240 |

The characteristics of the deasphalted oil DAO obtained and the yield of deasphalted oil DAO with respect to the vacuum residue feed at the inlet to the selective deasphalting unit are detailed in Table 5.

TABLE 5

| Yields and characteristics of deasphalted oil DAO obtained | |
|---|---|
| DAO yield (% by wt) | 95 |
| DAO sulphur (% by wt) | 0.54 |
| Conradson carbon (%) | 12 |
| Ni + V (ppm) | 8 |
| Viscosity at 100° C. (CSt) | 168 |

The deasphalted oil DAO was separated into two streams:

50% by weight of the deasphalted oil DAO obtained was used to prepare a fuel oil, 50% by weight of the deasphalted oil DAO obtained was recycled to the inlet to the ebullated bed hydroconversion unit.

The yields and sulphur contents of each fraction obtained from the outlet from the overall fixed bed hydrotreatment+ebullated bed hydroconversion+selective deasphalting concatenation are given in Table 6.

TABLE 6

Yields (Yld) and sulphur content (S) at outlet from overall concatenation of fixed bed hydrotreatment + ebullated bed hydroconversion + selective deasphalting (% by weight/fresh feed)

| Products | Yld (% by wt) | S (% by wt) |
|---|---|---|
| $NH_3$ | 0.23 | 0 |
| $H_2S$ | 3.05 | 94.12 |
| $C_1$-$C_4$ (gas) | 3.03 | 0 |
| Naphtha (PI - 180° C.) | 6.24 | 0.005 |
| Diesel (180° C.-350° C.) | 20.14 | 0.03 |
| Vacuum distillate (350° C.-540° C.) | 39.74 | 0.24 |
| Deasphalted oil DAO (540° C.+) | 26.75 | 0.54 |
| Asphalt (540° C.+) | 2.82 | 0.74 |

The hydrogen consumed over the whole of the process represented 1.99% by weight of the fresh feed introduced into the inlet to the hydrotreatment section. The overall conversion into deasphalted oil DAO (540° C.+) was 64%.

A mixture B was prepared from the vacuum distillate (350° C.–540° C.) and deasphalted oil DAO (540° C.+) fractions in the following proportions:

vacuum distillate fraction (350° C.–540° C.): 43% by weight of mixture B, deasphalted oil fraction DAO (540° C.+): 57% by weight of mixture B.

A bunker fuel B was obtained with a sulphur content of 0.42% by weight and with a viscosity of 380 cSt at 50° C. In addition, its sediment content after aging was equal to 0.05% by weight.

The process of the invention can thus be used to produce a stable bunker fuel B, with a low sulphur content which complies with the requirements of ISO standard 8217: 2012 in particular. The overall conversion is substantially improved compared with a process without selective deasphalting, meaning that high grade distillates can be produced as a complement to bunker fuel with a low sulphur content.

The invention claimed is:

1. A process for the treatment of a hydrocarbon feed having a sulphur content of at least 0.5% by weight, an asphaltenes content of at least 1% by weight, an initial boiling point of at least 340° C., and a final boiling point of at least 480° C., in order to obtain at least one deasphalted oil fraction with a sulphur content of 0.5% by weight or less and a sediment content of 0.1% by weight or less, comprising, in succession:

a) fixed bed hydrotreatment, in which the hydrocarbon feed and hydrogen are brought into contact over at least one hydrotreatment catalyst, b) optionally, separating effluent obtained from the hydrotreatment a) into at least one light fraction and at least one heavy fraction, c) hydroconversion of at least a portion of effluent obtained from a) or at least a portion of the heavy fraction obtained from b) and optionally at least a portion of the light fraction obtained from b) in at least one reactor containing at least one supported ebullated bed catalyst, d) separating effluent obtained from c) in order to obtain at least one gaseous fraction and a liquid hydrocarbon fraction, by an atmospheric distillation, in which the effluent obtained at the end of c) is fractionated by atmospheric distillation into at least one atmospheric distillate fraction and at least one atmospheric residue fraction, then a vacuum distillation in which at least a portion of the atmospheric residue fraction obtained after atmospheric distillation is fractionated by vacuum distillation into at least one vacuum distillate fraction and at least one vacuum residue fraction; and at least a portion of the vacuum residue fraction is recycled to the hydrotreatment a), e) at least one selective deasphalting in order to separate at least one asphalt fraction and at least one deasphalted oil fraction, the deasphalting being carried out at least by bringing at least a portion of the liquid hydrocarbon fraction obtained from d), comprising at least a portion of said vacuum residue fraction and optionally a portion of said vacuum distillate fraction, into contact with a mixture of at least one polar solvent and at least one apolar solvent under subcritical conditions for the mixture of solvents used, f) recycling at least a portion of said deasphalted oil fraction obtained from e) upstream of the hydrotreatment a) and/or to the inlet for the hydroconversion c).

2. The process according to claim 1, in which the deasphalting e) comprises at least two deasphaltings in series in order to separate at least one asphalt fraction, at least one deasphalted oil fraction termed heavy DAO and at least one light deasphalted oil fraction termed light DAO, at least one of said deasphaltings being carried out by bringing at least a portion of the liquid hydrocarbon fraction obtained from d) into contact with a mixture of at least one polar solvent and at least one apolar solvent under subcritical conditions for the mixture of solvents used.

3. The process according to claim 2, in which in f), at least a portion of the deasphalted oil fraction termed heavy DAO obtained from e) is recycled upstream of the hydrotreatment a) and/or to the inlet for the hydroconversion c).

4. The process according to claim 1, in which e) is carried out at an extraction temperature in the range 50° C., to 350° C., and at a pressure in the range 0.1 to 6 MPa.

5. The process according to claim 1, in which the fixed bed hydrotreatment is carried out at a temperature in the range 300° C., to 500° C., at an absolute pressure in the range 2 MPa to 35 MPa, with an hourly space velocity of the hydrocarbon feed in the range from 0.1 $h^{-1}$ to 5 $h^{-1}$, and the quantity of hydrogen is in the range 100$Nm^3/m^3$ to 5000 $Nm^3/m^3$.

6. The process according to claim 1, in which the polar solvent used is (i) a pure aromatic solvent, a naphthenoaromatic solvent, a polar solvent comprising hetero-elements, or a mixture thereof, or (ii) a cut rich in aromatics, a cut obtained from FCC (Fluid Catalytic Cracking), a cut derived from coal, a cut derived from biomass or a cut derived from a biomass/coal mixture.

7. The process according to claim 1, in which the apolar solvent used comprises a solvent composed of a saturated hydrocarbon containing 2 or more carbon atoms.

8. The process according to claim 1, in which the hydroconversion c) is carried out at an absolute pressure in the range 2.5 MPa to 35 MPa, at a temperature in the range 330° C., to 550° C., with a space velocity in the range from 0.1 $h^{-1}$ to 5 $h^{-1}$, and with a quantity of hydrogen of 50 $Nm^3/m^3$ to 5000 $Nm^3/m^3$.

9. The process according to claim 1, in which least a portion of the atmospheric residue fraction is sent to the hydroconversion c).

10. The process according to claim 1, in which the hydrocarbon feed is an atmospheric residue, straight run vacuum residue, crude oil, topped crude oil, deasphalting resin, asphalt or deasphalted pitch, a residue obtained from a conversion process, an aromatic extract obtained from production lines for lubricant bases, bituminous sand or a derivative, oil shale or a derivative, or source rock oil or a derivative, used alone or as a mixture.

11. The process according to claim 10, in which the hydrocarbon feed is diluted with a co-feed that is a hydrocarbon fraction or a mixture of lighter hydrocarbon fractions which may be products obtained from a fluidized bed catalytic cracking process, a light oil cut LCO, a heavy oil cut HCO, a decanted oil, a FCC residue, a diesel fraction; one or more cuts obtained from a coal liquefaction process or from biomass, aromatic extracts, or non-oilfield feeds.

12. The process according to claim 1, in which the deasphalted oil fraction obtained is mixed with one or more cutter stocks that are light oil cuts (LCO) from catalytic cracking, heavy oil cuts (HCO) from catalytic cracking, a catalytic cracking residue, kerosene, diesel, vacuum distillate and/or a decanted oil.

13. The process according to claim 12, in which the cutter stock is a portion of kerosene and/or diesel or vacuum diesel type light hydrocarbon fraction obtained from the separation b).

14. The process according to claim 1, in which the apolar solvent used comprises a solvent composed of a saturated hydrocarbon containing 2 to 9 carbon atoms.

* * * * *